US005727756A

United States Patent [19]

Rowe

[11] Patent Number: 5,727,756

[45] Date of Patent: Mar. 17, 1998

[54] MODULAR KITE SYSTEM

[76] Inventor: David E. Rowe, 120 E. Ogden Ave., Hinsdale, Ill. 60521

[21] Appl. No.: 568,025

[22] Filed: Dec. 6, 1995

[51] Int. Cl.[6] ..... B64L 31/06

[52] U.S. Cl. ..... 244/153 R; 244/155 R; 213/DIG. 30

[58] Field of Search ..... 244/153 R, 155 R, 244/155 A; 273/DIG. 30; 446/34; 403/393, 331

[56] References Cited

U.S. PATENT DOCUMENTS

| | | | |
|---|---|---|---|
| 2,693,330 | 11/1954 | Green | 244/153 R |
| 2,744,701 | 5/1956 | Robey . | |
| 3,494,578 | 2/1970 | Cureton . | |
| 3,894,704 | 7/1975 | Vincent . | |
| 3,948,471 | 4/1976 | Pearce et al. . | |
| 3,963,200 | 6/1976 | Arnstein . | |
| 4,015,802 | 4/1977 | Heredia . | |
| 4,228,977 | 10/1980 | Tanaka | 244/153 R |
| 4,243,191 | 1/1981 | Loy | 244/153 R |
| 4,383,667 | 5/1983 | Weathers | 244/153 R |
| 4,729,530 | 3/1988 | Jalbert . | |
| 4,805,853 | 2/1989 | Battles . | |
| 4,981,273 | 1/1991 | Petteys | 244/153 R |
| 5,078,530 | 1/1992 | Kim | 403/331 |
| 5,098,039 | 3/1992 | Linden, Jr. . | |
| 5,213,289 | 5/1993 | Barresi . | |
| 5,429,875 | 7/1995 | Okamoto et al. . | |
| 5,524,394 | 6/1996 | Szabo et al. | 403/331 |

FOREIGN PATENT DOCUMENTS

| | | | |
|---|---|---|---|
| 1546780 | 10/1967 | France | 244/153 R |

*Primary Examiner*—Andres Kashnikow
*Assistant Examiner*—Tian Dinh
*Attorney, Agent, or Firm*—Dvorak & Orum

[57] ABSTRACT

A modular kite system using flexible attachment means to join a variety of flat wings to a three-dimensional center section or fuselage, which itself can be of various configurations. Hook and loop fasteners are used to position movable cross spar sleeves along the wings which adjust the flexibility of the cross spar(s).

7 Claims, 5 Drawing Sheets

MODULAR KITE SYSTEM

BACKGROUND—DISCUSSION OF PRIOR ART

Kites and kite-flying were once considered toys and play for children. This has now developed into an adult sport, with keen interest in design advanced technology.

Kites have been flown for centuries and a limitless variety of designs have evolved. Numerous patents have been issued for specific kite designs which have unique characteristics, and these include "modular" kites.

U.S. Pat. No. 3,948,471 (Pearce) discloses a prism-shaped kite with an air dam and tail. The frame is built from a number of identical struts and connectors. The connectors are complex and the struts are hollow, substantially rectangular, and arched with decreasing wall thickness at their ends. Both components are made of molded high strength plastic, and the structures are complex and costly to manufacture.

U.S. Pat. No. 3,894,704 (Vincent) shows a modular kite comprised of four conventional kites linked together with two longer cross spars or sticks. This invention is limited to a single, not variable, configuration.

The prior art does not show a modular kite system that can easily and quickly change the shape, configuration, and flight characteristics of the entire kite. Moreover, none of the prior art structures have the adaptability, variability, and range of combinations inherent in the present invention.

OBJECTS AND ADVANTAGES

Some kites perform best in light air, others are better suited for moderate wind, while others need strong winds to keep them flying. Thus, on any given day, a kite flyer may carry several kites of different designs into the field in order to fully enjoy the sport. Separate kites can be expensive to purchase, storage can be problematic, and carrying several kites can be cumbersome.

The present invention is the development of a new way to construct, assemble, and modify kites. This invention is applicable to all kites, and more particularly those with a center section or body, and a set of wings or sails. The body is covered with a skin or sheet of plastic, papers, fabric, or the like. The skin is stretched over a frame formed by two or more vertical sticks or longerons. The wings are constructed of similar skin sheet material and extend outward from the center frame. A cross spar (or spars) usually hold the wings and frame in a desired transverse shape. Like all kites, the present invention employs a bridle string or bridles, which are attached to the kite. The kite string, or tether, is attached to the bridle, or bridles, and is held by the kite flyer.

An object of the invention is to provide a kite system of modular components which can be added, removed, and/or adjusted. The system consists of center frames and multiple wing designs that are interchangeable. By changing the wings on a center body, a different kite with different aerodynamic and flight characteristics is created in order to better suit wind conditions, aesthetics, and individual preferences and tastes.

This invention provides unique solutions to kite building. Commercially available "hook and loop" fasteners or other flexible closures such as slide fasteners or interlocking channels are used to attach the wings to the body of the kite. Hook and loop type fasteners are also employed to adjust the flexibility and positioning of cross spars which span the width of the wings.

Another object of this invention is to provide a single kite frame to which can be added modular or interchangeable wings of different sizes, shapes, designs, and characteristics to suit the needs and preferences of the flyer.

Another object of this invention is to reduce the weight of the cross spar(s) which keep the wings spread and the skin taut. As wind presses against the wings, the cross spars flex to form an aerodynamic dihedral. If properly designed, the dihedral angle adds lift to the kite and also imparts stability and control to the craft. The flexibility of a cross spar is critical. Traditional kite design and construction makes a trade-off in the spar's composition, thickness, and weight. If a spar is too flexible, the kite looses stability and control, and can easily break under strain. If the spar is too stiff, the kite looses many of its desired aerodynamic properties, and a heavier spar adds significant weight to the kite which further compromises the flight performance of the kite. Recent designs have overcome some of these difficulties by using state of the art materials such as carbon fiber rods. While these materials are strong and light weight, they are expensive and often difficult to replace by the flyer.

To address this problem, the present invention includes the design and use of movable cross spar sleeves. The sleeves strengthen and support the spar along the wing which permits lighter and less expensive spar construction. The sleeves also adjust the spar's flexibility to optimize the control, stability, and aerodynamic qualities of the wing and the kite.

The design of the present invention provides durability. At least two longerons (solid vertical members) are fully supported along their lengths by sleeves. In addition, adjustable cross spar adjustment sleeves provide optimal support to the cross spar and distribute the stresses more evenly along its structure.

The present invention uses light but inexpensive materials for the rigid longerons and cross spars. Less weight improves the weight-to-area ratio of the kite, which also improves its lift to drag ratio. Moreover, the kite owner can inexpensively replace the longerons and cross spars.

Yet another advantage of the present invention is that the design minimizes the need for additional parts or tools.

Another object of this invention is to reduce the cost of manufacturing and thus the marketability of the kites. The frames and wings are simple to design and manufacture. The present invention provides a kite with a single frame on which various interchangeable modular wings can be mounted. A wide variety of wings which are inexpensive can be used with the structure.

The present invention can be quickly and easily assembled, disassembled, stored, modified, or adjusted, without need of tools. The entire assembly can be dismantled and rolled into a compact package for storage and carrying. Moreover, different wings can be interchanged in seconds creating a kite with a new configuration with a minimal amount of adjustment, due to use of flexible fasteners or interlocking channels.

DESCRIPTION OF THE PREFERRED EMBODIMENTS

Figure 1:
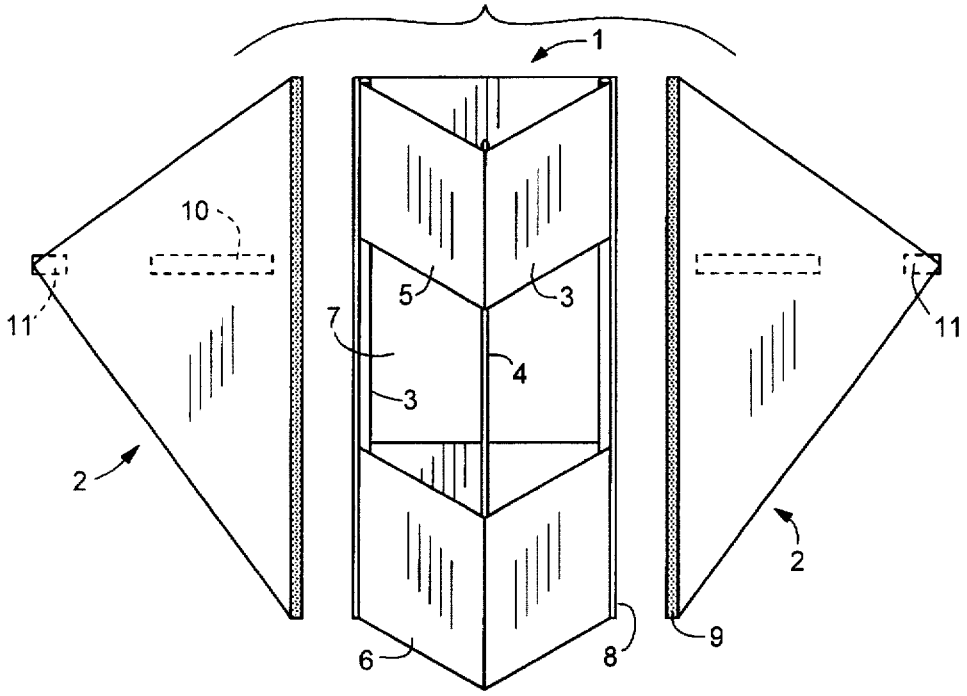
FIG. 1 is a front view of a triangular body or frame module and two unattached modular wings.

FIG. 1 shows two elements of the modular system, a center body frame 1 and two wings 2. Various other body frames and wings can be employed.

A frame 1 is formed by two or more vertical sticks or longerons 4 that run the length of the body. The longerons are in the form of sticks of wood or other light weight material. The longerons are usually enclosed in fabric-like sleeves 3 which are attached at the corners of a forward cell 5 and aft cell 6. The cells are constructed with light-weight sheet material of fabric, plastic, or similar material which also forms the longeron sleeves. Wings 2 are also made of the same sheet material. An open vent 7 is often employed in many designs and separates the forward and aft cells. However, different frame modules can be designed for two- or three-dimensional shapes and vents may not be necessary.

Two frame mounts 8 are attached to the back of the body frame, along the length of the kite. The frame mounts are in the form of strips of "hook and loop" fasteners but other flexible closures such as slide fasteners or interlocking channels could be employed.

Wing mounts 9 (FIGS. 1 and 2) are affixed along the length on the inside edge of the wings, facing the front of the wing (towards the wind). The wing mounts are strips of hook and loop fasteners and are the opposite of those members used on the frame mounts 8. The use of these closures allows optional detachability of the wing modules to the frame modules, thus completing the basic architecture of the kite.

Figure 4:
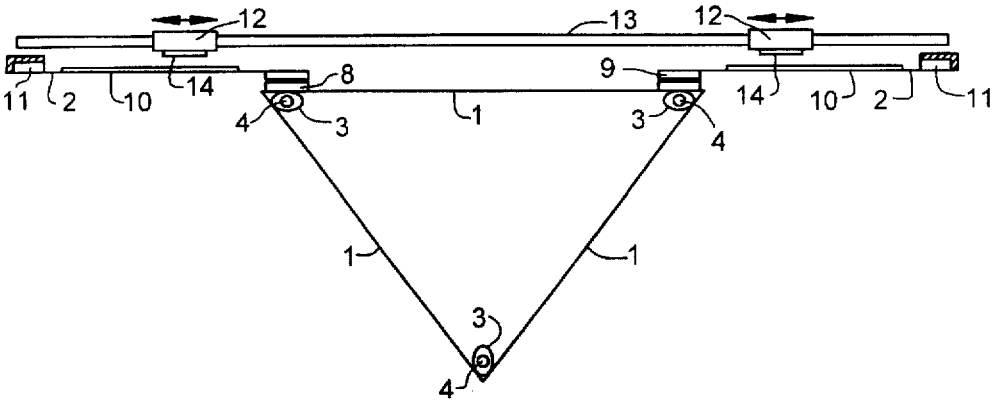
FIG. 4 is a vertical view of an assembled kite with cross spar unattached.
Figure 4A:
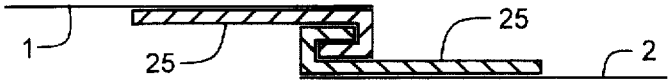
FIG. 4A shows an enlarged cross-section of a variation of the attachment means between the body and the kite wing, this variation being in the form of sliding interlocking channels.

An alternative means of attaching wings 2 to the frame 1 is shown in FIG. 4A, which shows in cross-section two slidable interlocking channels 25 which are attached to the body 1 and to the wing 2, respectively, by adhesive, or the like. They replace fastener members 8 and 9 shown in FIG. 4. The channels 25 are stiff and could eliminate the need for longerons 4 and the supporting sleeve 3.

Figure 2:
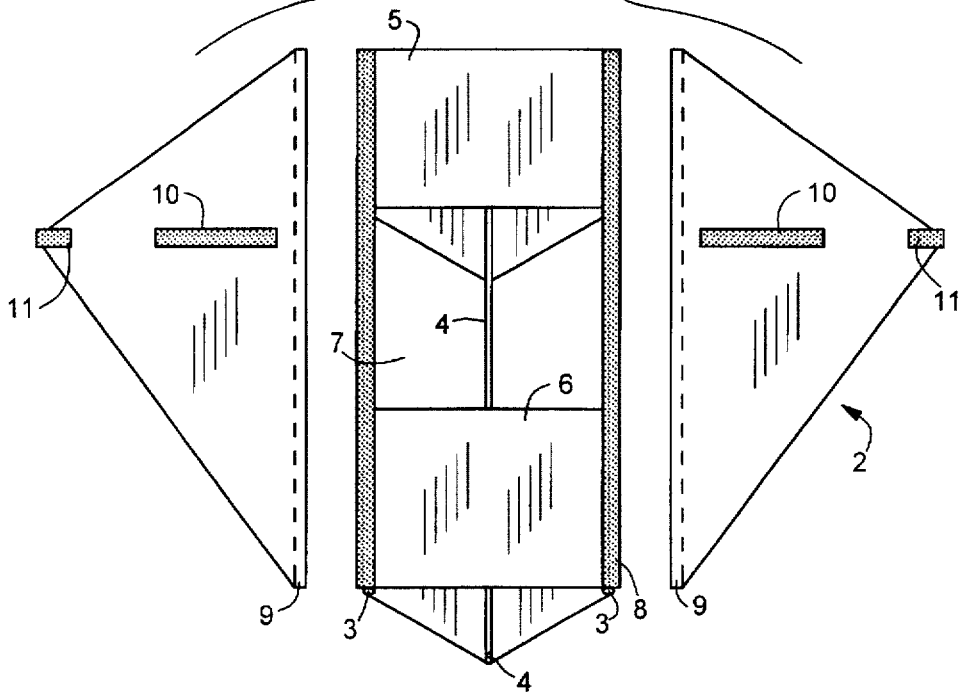
FIG. 2 is a rear perspective view of a body frame, with two unattached wings.
Figure 3:
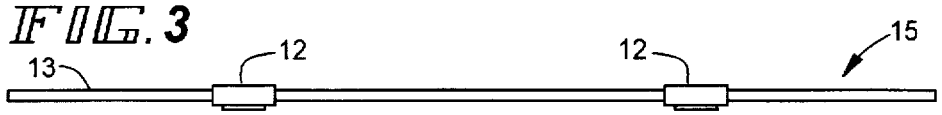
FIG. 3 is a top view of a cross spar with fasteners.

FIG. 2 is the rear view or leeward side of the wing and frame. Two spar pockets 11 are fixed to the back side at the outside edge of the wing. The location and orientation of the pockets depend on the shape and design of the wing. The spar pockets can be made of sewn fabric or may be any commercially available material. The purpose of the pockets is to receive the ends of a cross spar 13 which keeps the wings spread, taut, and away from the center body frame. Spar adjustment strips 10 are flexible closures mounted on the back side of the wings. They extend transversely about half way across the wings, and in line with the spar pockets. The spar adjustment strips shown are of either the "loop" side or the "hook" of hook and loop closures. The assembly for cross spar 13 and cross spar adjustment sleeves 12 are shown in FIG. 3. The cross spar adjustment sleeves are cylindrical tubes sewn of fabric. Non-sleeve configurations are also envisioned, whereby the fastener or closure member for the cross spar 13 is slidably engagable with the cross spar. The spar fits snugly through the sleeves. Small "hook" or "loop" closures 14 are attached to the spar adjustment sleeves. The spar adjustment sleeves engage the spar to the cross spar adjustment strips. In this way the sleeves can be moved or adjusted along the length of the spar adjustment strips on the wings.

FIG. 3 shows the top view of the spar adjustment assembly 15 showing the relationships among the various parts of the structure. The spar slidably adjustable sleeves 12 can be adjusted along the spar adjustment strips 10 on the back side of the wing. The cross spar 13 passes through the spar sleeves 12 and its ends are inserted into the two spar pockets 11 which create the rigid framework that extend the wings outward from the frame of the body.

FIG. 4 illustrates how the adjustable cross spar adjustment sleeves 12 are adjusted for attachment to a selected position on the adjustment strip on the wing 2, to adjust the flexibility of the cross spar 13. The sleeves reinforce and strengthen the cross spar against breakage and reduces the total weight of the kite. As the wind strikes the wings, the spar is deflected causing it to bow. Some bowing is desirable since it forms a dihedral angle in the wing that aids the stability and control of the craft. However, excessive bowing can be detrimental, and in extreme cases, can cause the cross spar to break. Conventional kite designs adjust spar flexibility and strength by using different material or weights, and as the spar length increases, stronger and heavier materials are needed. This adds weight to the kite and decreases the spar's flexibility, and the flight characteristics of such kites are thereby compromised. In the present invention, repositioning the sleeves toward the center of the kite increases the flexibility of the spar, while moving the sleeves to a point roughly one-third of the way from the end of the spar maximizes its stiffness and strength. Two or more spar sleeves can be used on each side of the wing to further reinforce the spar.

Figure 5:
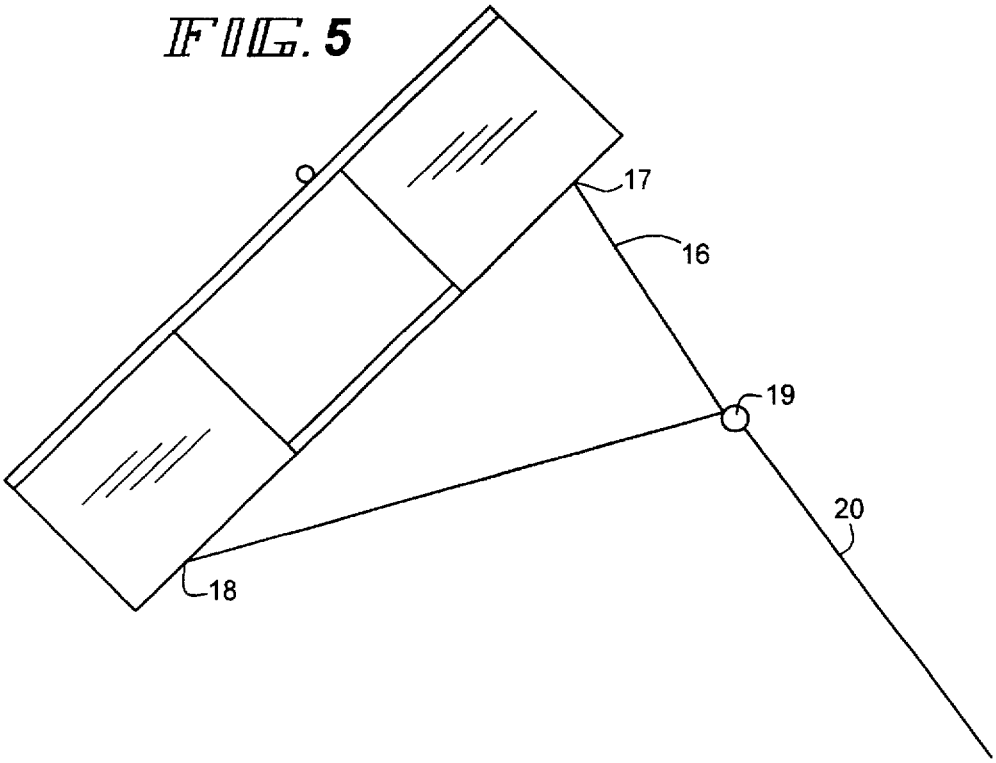
FIG. 5 is a side view of an assembled kite showing the positioning of the bridle and kite string.

FIG. 5 shows a side view of a kite in flight. The two ends of bridle string 16 are attached to the forward most or leading longeron(s) at bridle points 17 and 18. The bridle points are usually in the upper and lower portion of the kite. Bridle ring 19 is knotted into the bridle string so it can be adjusted along the length of the bridle. The ring adjusts the kite's angle of attack against the wind. The length of the bridle string, and the angle of attack may vary with the configuration of the kite being flown. A kite string or tether 20 is attached to the bridle ring. The kite string is held by the kite flyer.

Figure 6:
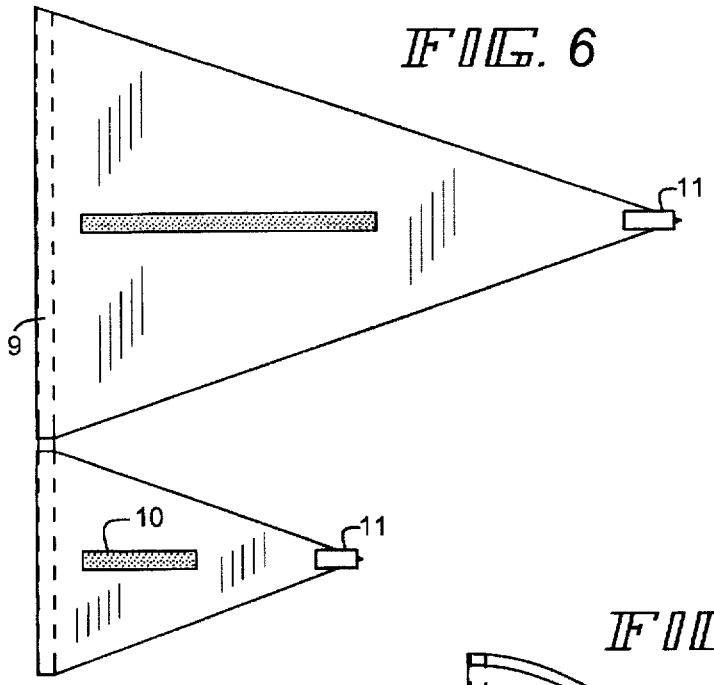
FIG. 6 shows how various wings can be attached to a standard body module.
Figure 7:
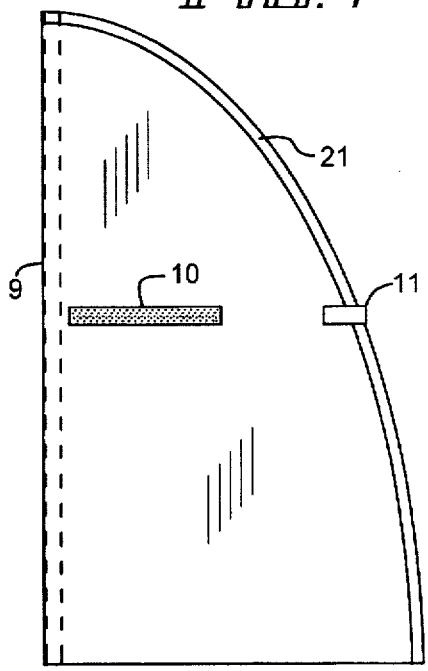
FIG. 7 shows an attachable wing having leading edge spar sleeves for receiving a leading edge spar.
Figure 8:
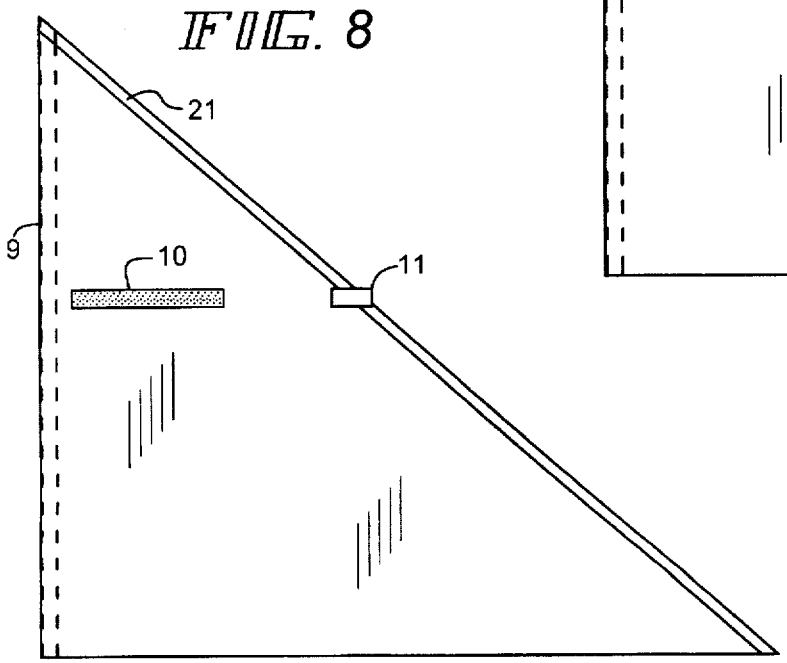
FIG. 8 shows another form of attachable wing having leading edge spar sleeves for receiving a leading edge spar.

FIGS. 6, 7, and 8 show only three of the many possible designs for the modular wings. As in the discussion for FIGS. 1 and 2, each wing has the same embodiments: wing mounts 9, spar adjustment strips 10, and spar pockets 11.

Wing shapes such as shown in FIGS. 7 and 8 often require a further flexible wing spar, not visible, that is inserted in a wing sleeve 21 on the leading edge of the wing. The spar sleeve is simply constructed by folding a seam, and in the case of fabric, sewing the sleeve into the wing. These embodiments are well known to any familiar with the art and craft of kite making. The wings illustrated in FIGS. 6–8 show only some of the possibilities, including double wings, that can be fashioned for the wing modules.

Figure 9:
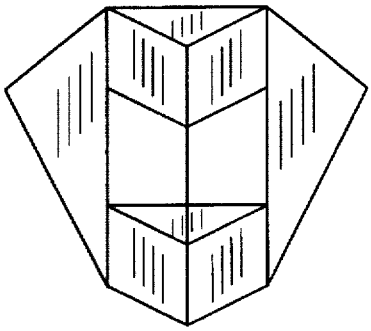
FIGS. 9–14 illustrate some of the variations of wing designs that might be used in the present invention.
Figure 10:
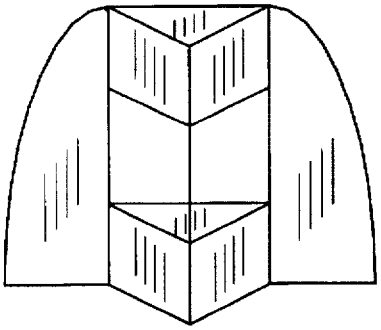
Figure 11:
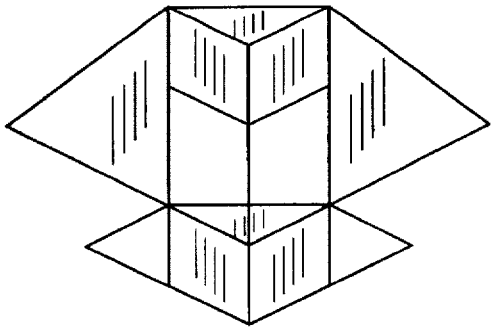
Figure 12:
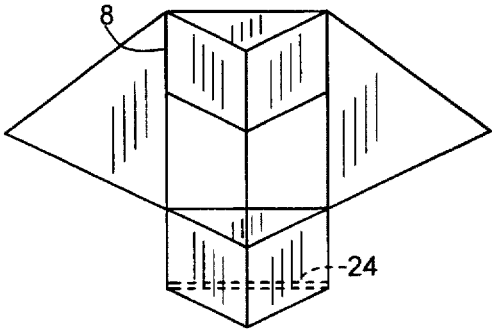
Figure 13:
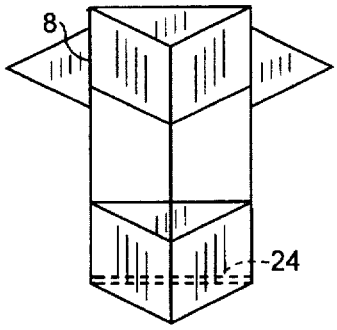
Figure 14:
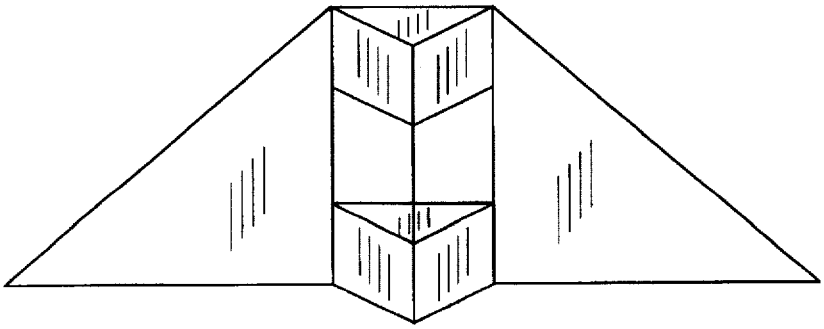

FIGS. 9 through 14 show how various wing modules can be mounted on a given frame. FIG. 9 is a traditional "Military Kite" that flies best in moderate to strong winds. FIG. 10 has rounded wings and requires a flexible wing spar to maintain the shape of the wing. FIGS. 11, 12, and 13 show variations of the wings of FIG. 6 used individually or together. FIG. 14 is a classic "delta" shape.

Under certain configurations such as examples in FIG. 12 and FIG. 13, the combined lateral forces of the cross spar and wing are insufficient to keep the aft cell filled with air. In these cases, a cell spreader bar assembly 24 is needed to keep the rear longerons spread apart, as shown in FIGS. 12 and 13. The assembly consists of a stick or rod to which the "hook" or "loop" portion of the closure is fixed at the ends of spreader bar 24. This assembly can be as simple as stapling or gluing (not shown) the strip 26 to the end of the spreader bar 24. Once assembled, the spreader bar is mated to the frame mount 8 as shown. Note that any of the frames contemplated under this invention can be flown without wings in heavy winds when two or more spreader bars are employed.

Figure 15:
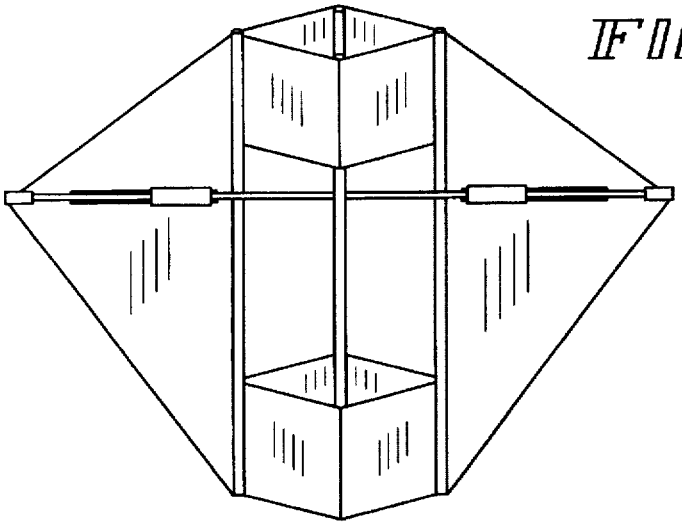
FIGS. 15–17 illustrate some of the variations of kite body designs that might be used in the present invention.
Figure 16:
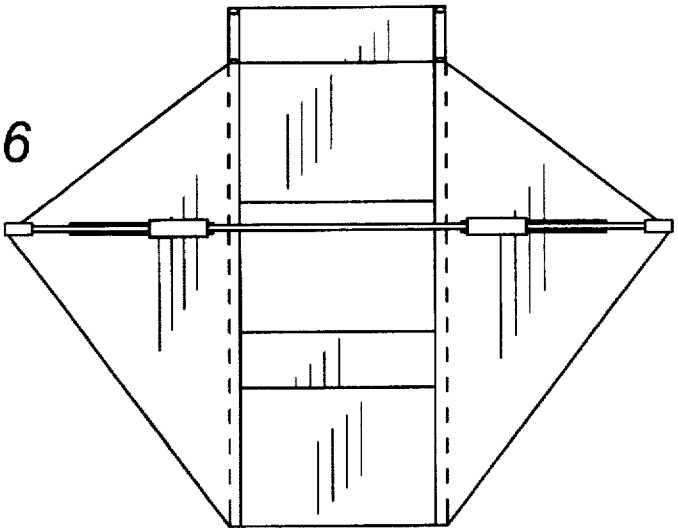
Figure 17:
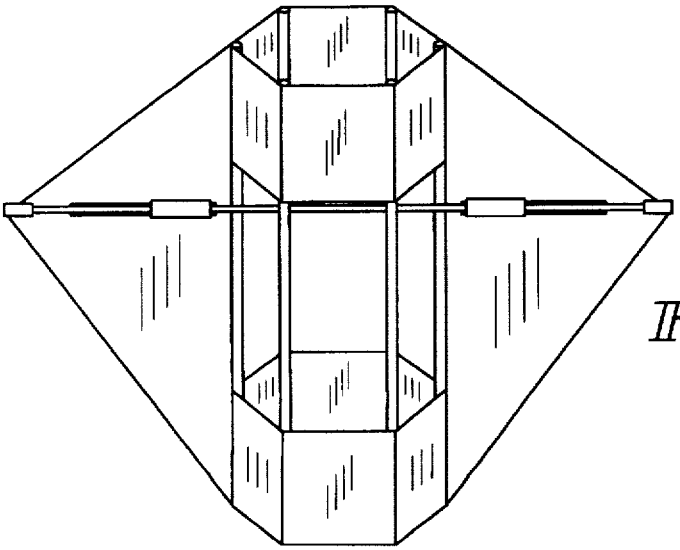

FIGS. 15, 16, and 17 illustrate three of many possible designs for central body frames. Frame modules of FIGS. 15 and 16 are classic winged box kites where the wings radiate from opposite and adjacent corners of the box respectively. The frame shown in FIG. 17 is a hexagonal shape. A frame, however, can be substantially flat or any polyhedron with parallel sides, and might also be formed of a round or oval section. As previously suggested, a frame envisaged under this invention can be designed with a single cell or with multiple cells and multiple vents. The drawings illustrate a small range of possibilities that can be created.

What is claimed is:

1. A collapsible modular kite structure for readily permitting simplified reconfiguration of the overall shape of the kite, comprising a modular body having one or more longitudinal members and pliable sheet material extending between the members, a pair of wings selected from a group of pairs of variously sized and shaped wings which are formed of pliable non-rigid sheet material and are readily attachable and detachable to and from the body, means for detachably attaching the wings to the body in a manner so as to prevent relative movement therebetween, and a transversely disposed rigid cross spar for supporting the wings and means for adjustably attaching the cross spar to the kite.

2. A kite structure as claimed in claim 1 wherein said means for adjustably attaching the cross spar to the kite comprising means fixedly attached to the surface of each wing for ready attachment and detachment to the cross spar, and attachment means slidably positioned on the transverse cross spar for engaging said means fixedly attached to the surface of each wing, at selected positions.

3. A kite structure as claimed in claim 1 wherein the means for attaching wings to the body are hook and loop type fasteners.

4. A kite as claimed in claim 1 wherein the means for attaching wings to the body are in the form of flexible slide fasteners.

5. A kite as claimed in claim 1 wherein the means for attaching the wings to the body are in the form of interlocking channels.

6. A kite structure as claimed in claim 2 wherein the attaching means on the wings and the attaching means on the cross spar are in the form of hook and loop fasteners.

7. A kite structure as claimed in claim 1 comprising bridle means connected at selected axial points on one or more of the longitudinal body members.

* * * * *